US005131578A

United States Patent [19]

Unuma

[11] Patent Number: 5,131,578

[45] Date of Patent: Jul. 21, 1992

[54] CLAMPER OF PAPER FEED TRACTOR

[75] Inventor: Sadao Unuma, Aichi, Japan

[73] Assignee: Tokai Kogyo Kabushiki Kaisha, Aichi, Japan

[21] Appl. No.: 704,740

[22] Filed: May 20, 1991

Related U.S. Application Data

[63] Continuation of Ser. No. 487,852, Mar. 5, 1990, abandoned.

[30] Foreign Application Priority Data

Mar. 27, 1989 [JP] Japan ..... 1-74486

[51] Int. Cl.[5] ..... B65M 20/20

[52] U.S. Cl. ..... 226/74; 400/616.1

[58] Field of Search ..... 226/74, 75; 400/616, 400/616.1, 616.2

[56] References Cited

U.S. PATENT DOCUMENTS

| | | | |
|---|---|---|---|
| 4,129,239 | 12/1978 | Hubbard | 226/75 |
| 4,315,585 | 2/1982 | Seitz | 226/74 |
| 4,391,399 | 7/1983 | Seitz | 226/74 |
| 4,437,463 | 7/1984 | Hubbard et al. | 226/74 |
| 4,469,263 | 9/1984 | Seitz | 226/75 X |
| 4,569,468 | 2/1986 | Neer | 400/616.1 X |
| 4,735,352 | 4/1988 | Ueno et al. | 226/74 |
| 4,780,013 | 10/1988 | Sakai | 226/74 |
| 4,790,466 | 12/1988 | Ueno et al. | 226/74 |
| 4,819,849 | 4/1989 | Seitz | 226/74 |

*Primary Examiner*—Daniel P. Stodola
*Assistant Examiner*—P. Bowen
*Attorney, Agent, or Firm*—Wenderoth, Lind & Ponack

[57] ABSTRACT

A clamp for a paper feed tractor for clamping a paper feed tractor to a support shaft. Such a clamp is used for clamping the paper feed tractor to the support shaft at a predetermined distance from another paper feed tractor which corresponds to a width of a perforated paper to be fed by the tractors. The clamp comprises a cylindrical holder member which is cantilevered from a frame of the paper feed tractor, and a cylindrical clamp member rotatably mounted about the holder member. The holder member comprises a pair of semi-cylindrical holder plates, each of which has two outer peripheral surface portions of differing radii and a sloped outer peripheral portion joining the two outer peripheral surface portions. The larger radius outer peripheral surface portion of each holder plate is arranged diametrically opposite from the other. The clamp member has an inner peripheral surface which is shaped to be complementary to the outer periphery of the holder member, such that upon rotating the clamp member away from a position in which its inner periphery is not complementary to the outer periphery of the holder member, the holder member is deflected radially inwardly so as to clamp against the support shaft.

13 Claims, 8 Drawing Sheets

CLAMPER OF PAPER FEED TRACTOR

This application is a continuation of now abandoned application, Ser. No. 07/487,852 filed on Mar. 5, 1990 now abandoned.

BACKGROUND OF THE INVENTION

1. Field of the Invention

This invention relates to a clamper of a paper feed tractor for clamping and fixing a pair of paper feed tractors for feeding perforated paper to a support shaft with a gap corresponding to the width of the perforated paper.

2. Description of the Prior Art

As a conventional clamper used for the purpose described above, a clamper shown in FIGS. 10 through 12 is known conventionally.

This clamper consists of a plurality of sleeve plates 42 projecting from the outer side surface of a frame 41 that constitutes a paper feed tractor, and a cylindrical clamp member 43 fitted rotatably to the outside of these sleeve plates 42

When the clamp member 43 fitted to the outside of the sleeve plates 42 is rotated, the sleeve plates 42 undergo deflection, and fasten and clamp a support shaft 44.

Therefore, since the support shaft 44 is clamped only partially by the tips of the sleeve plates 42, the clamp force is small. Since the plurality of sleeve plates 42 undergo deflection to thereby generate the clamp force, the sleeve plates 42 are elongated and impede the reduction of size of the paper feed tractor Another clamper is shown in FIGS. 13 through 15.

This clamper has a structure wherein one of the ends of a U-shaped clamp member 45 is fixed to the outer side surface of a frame 41 and a lock lever 46 causes elastic deformation of the clamp member 45 so as to hold and clamp the support shaft 44.

Accordingly, the clamp member 45 is necessary as a separate component and increases the cost of production.

Since the center of a clamp portion 45*a* of the clamp member 45 deviates from the center of the support shaft 44, the paper feed tractor is likely to incline and to clamp the support shaft 44 due to this deviation.

Moreover, the point of application of the force (F) for causing deformation of the clamp member 45 by the lock lever 46 is spaced apart by a predetermined distance (m) from the center of the support shaft 44. Accordingly, a large moment occurs around the support shaft 44 at the time of clamping so that the paper feed tractor is clamped while its driving sprocket (not shown) is firmly pressed to a driving shaft (not shown) Consequently, the frictional resistance of the rotary portion of the driving shaft increases and the driving force increases uselessly.

Still another clamper is shown in FIGS. 16 to 18.

This clamper consists of a lock lever 47 having an application portion 47*a* which is eccentric with respect to the center of the support shaft 44 and a wall plate 48 positioned in the proximity of this lock lever 47 and projecting from the frame 41.

When the application portion 47*a* of the lock lever 47 is strongly pushed into the wall plate 48, its reaction pushes and clamps the support shaft 44 from the side portion.

Consequently, a turning moment around the center (0) in the transverse direction of the paper feed tractor acts on it so that the paper feed tractor is clamped while being inclined with respect to the support shaft 44. If the paper feed tractor is obliquely clamped to the support shaft 44 in this manner, the holes of perforated paper deviate from feed pins 50 of a feed belt 49 and normal paper feed cannot be carried out.

SUMMARY OF THE INVENTION

The clamper of a paper feed tractor in accordance with the present invention is provided with a holder member consisting of a pair of semi-cylindrical holder plates formed by bisecting a cylindrical member in a circumferential direction. Each of the holder plates projectes from the outer side surface of a frame of a paper feed tractor in a cantilever arrangement both in a circumferential direction and in an axial direction. A cylindrical clamp member is fitted rotatably to the outside of this holder member. Two kinds of application outer peripheral surfaces having slightly different radii are formed continuously in the circumferential direction through a gentle step on the outer peripheral surface of each holder plate forming the holder member. A clamp inner peripheral surface having a radius a little greater than the radius of a support shaft is formed on the inner peripheral surface of the holder plate. Two kinds of application inner peripheral surfaces having slightly different radii and corresponding to the application outer peripheral surfaces of the holder members, respectively, are formed continuously through a gentle step in the circumferential direction at respective portions obtained by bisecting the inner peripheral surface of the clamp member in the circumferential direction. The rotation of the clamp member fitted to the outside of the holder member causes an application inner peripheral surface having a smaller radius and formed on the clamp member to run onto an application outer surface having a greater radius and formed on each holder plate so as to cause deflection of each holder plate in the circumferential direction and to thereby generate a clamp force.

BRIEF DESCRIPTION OF THE DRAWINGS

FIGS. 1 to 9 are drawings useful for explaining the present invention, wherein:

FIG. 1 is a perspective view of a paper feed tractor to which a clamper in accordance with the present invention is fitted;

FIG. 2 is an exploded perspective view of a holder member and a clamp member constituting the clamper in accordance with the present invention;

FIG. 3 is a perspective view of the clamp member when viewed from a different direction;

FIGS. 4 and 5 are transverse sectional views of the holder member and clamp member, respectively;

FIGS. 6 and 7 are transverse sectional views of the clamper in the unclamped state and in the clamped state, respectively;

FIG. 8 is a sectional view showing the intermediate state where the clamp member is being fitted to the holder member;

FIG. 9 is a sectional view taken along line A—A of FIG. 7;

FIGS. 10 to 18 are explanatory views useful for explaining the prior art technique, wherein:

FIGS. 10 and 11 are transverse sectional views showing a clamper using a clamp member in the unclamped state and in the clamped state, respectively;

FIG. 12 is a sectional view taken along line B—B of FIG. 11;

FIG. 13 is a front sectional view of the paper feed tractor to which a clamper using a U-shaped clamp member is fitted;

FIGS. 14 and 15 are, sectional views taken along line C—C of FIG. 13 in the unclamped state and in the clamped state, respectively;

FIGS. 16 and 17 are sectional views of a lock lever having an eccentric application portion 47*a* in the unclamped state and in the clamped state, respectively; and FIG. 18 is a sectional view taken along line D—D of FIG. 17.

DESCRIPTION OF THE PREFERRED EMBODIMENTS

FIGS. 1 to 9 show an embodiment of the present invention.

Figure 1:
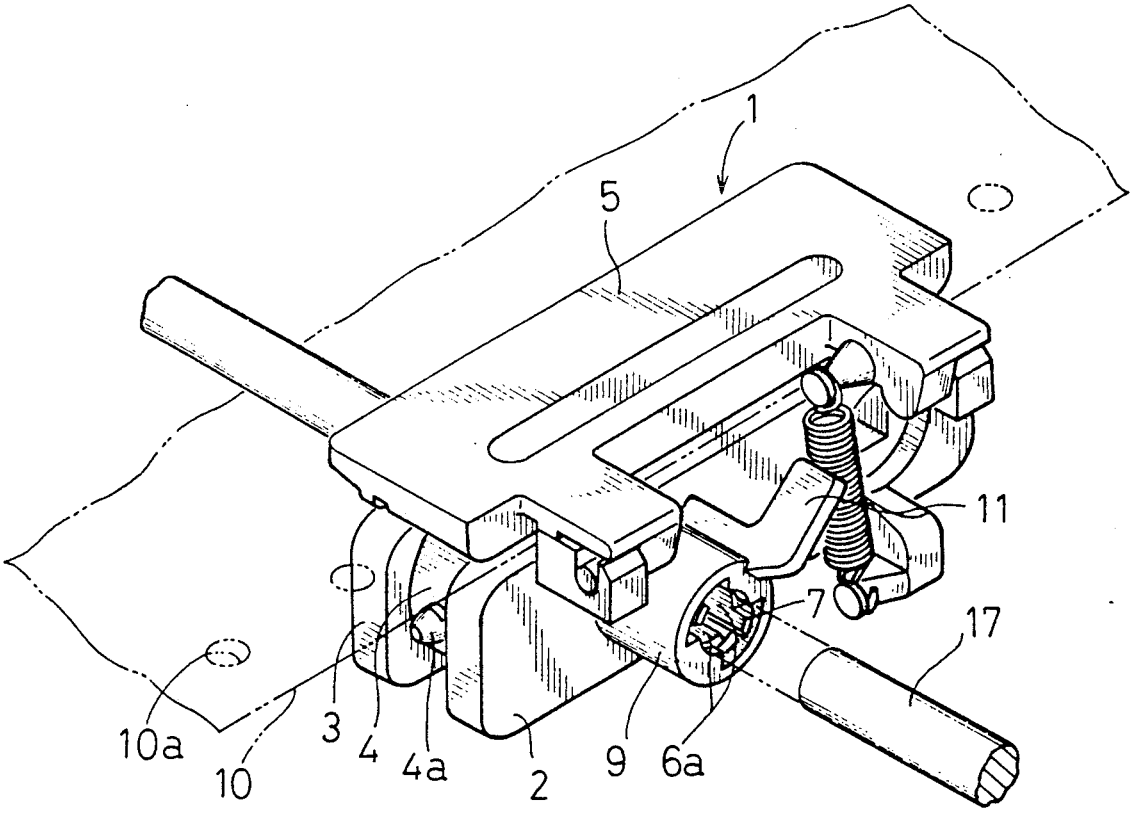
Figure 2:
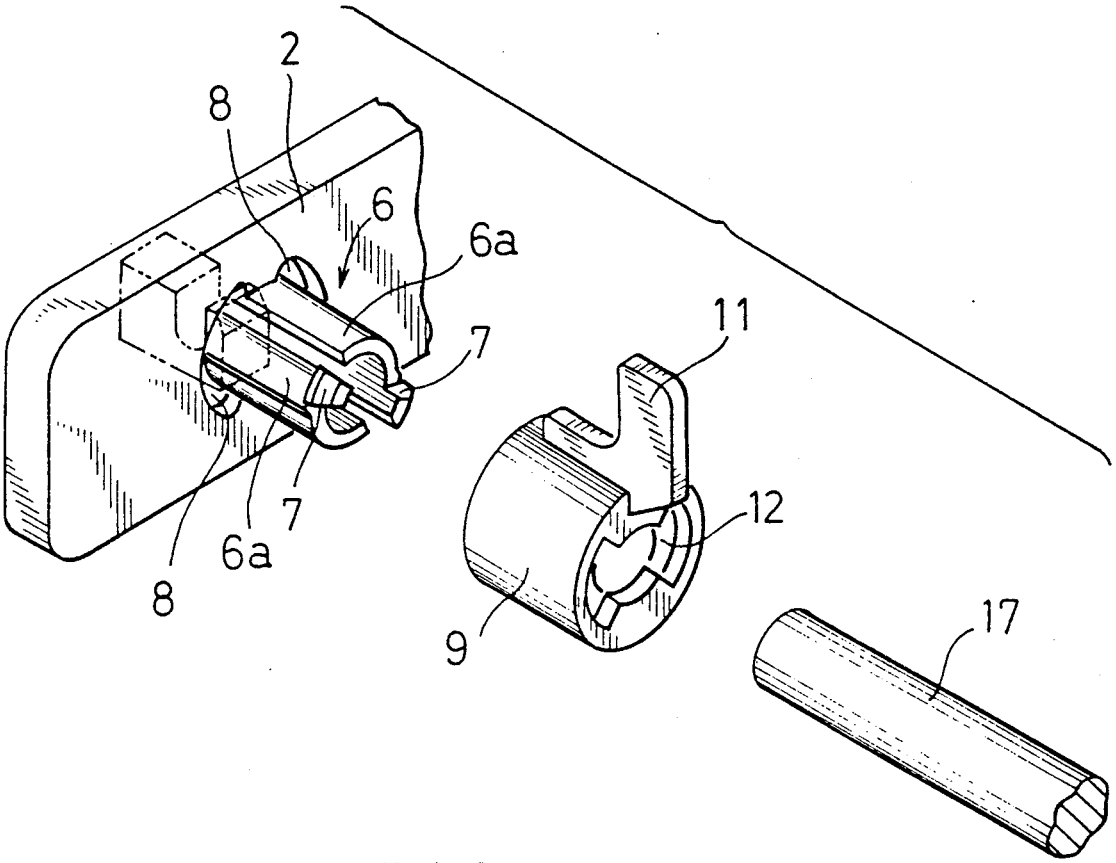
Figure 3:
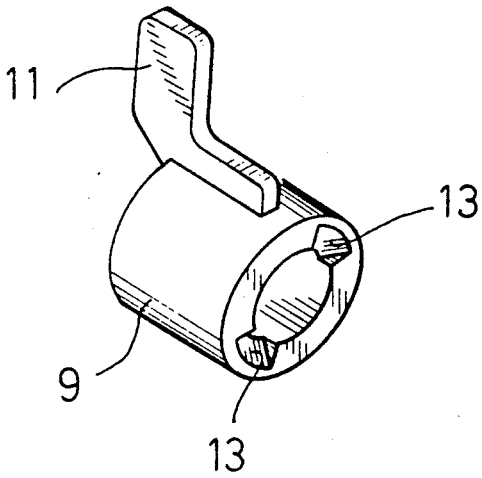

As shown in FIGS. 1 to 3, an endless feed belt 4 is disposed between a pair of frames 2, 3 constituting a paper feed tractor l, and a cover 5 for preventing the floating of perforated paper 10 is openably fitted to one (2) of the frames.

Though only one paper feed tractor 1 is shown disposed in FIG. 1, a pair of paper feed tractors 1 are fixed in practice, to a support shaft 17 with a gap between them which corresponds to the width the of perforated paper 10 by the clamper in accordance with the present invention. The feed belt 4 travels circulatingly and feeds perforated paper 10 while feed pins 4*a* of the feed belt 4 fit into holes 10*a* of the perforated paper 10.

A pair of semi-cylindrical holder plates 6*a* are adapted to project vertically from the side surface of the frame 2 and are disposed on the outer side surface of one of the frames 2.

Figure 4:
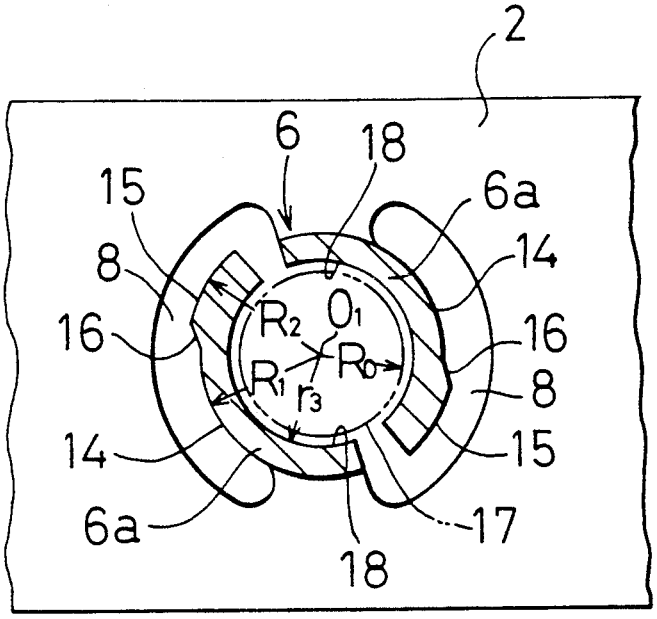

As shown in FIGS. 2 and 4, the pair of holder plates 6*a* have a semi-cylindrical shape obtained by dividing equally a cylindrical member in a circumferential direction, and the holder member 6 consists of the pair of holder plates 6*a*.

The frames 2, 3 are made of a resin and each cylindrical holder plate 6*a* is formed so as to project integrally from the frame 2 in a cantilever arrangement in both circumferential and axial directions. One of the ends of each holder plate 6*a* in the circumferential direction is a free end and each semi-cylindrical holder plate 6*a* can undergo deflection in both of its axial direction (longitudinal direction) and circumferential direction.

Fall-off prevention protuberances 7 are formed to project outwardly the portions of the holder plate 6*a* corresponding to the feed end portions in both axial and circumferential directions. A taper portion 7*a* is formed on each fall-off prevention protuberance 7 (see FIG. 8).

Figure 8:
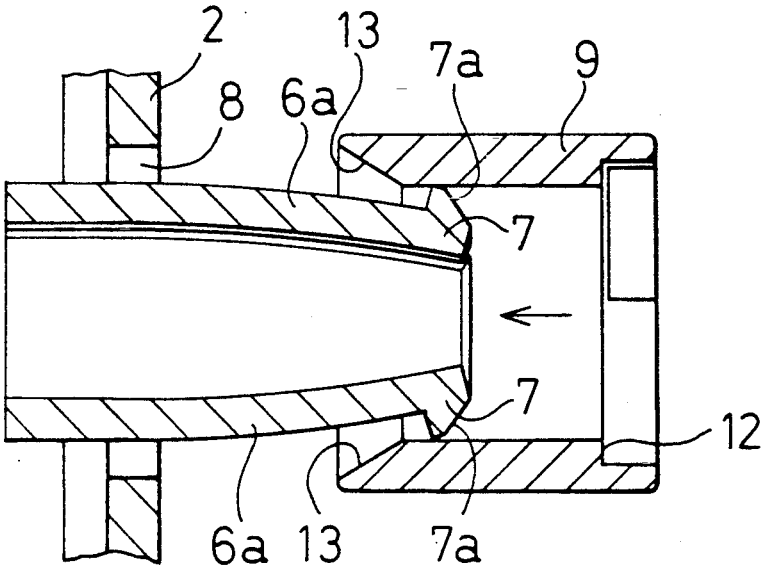
Figure 9:
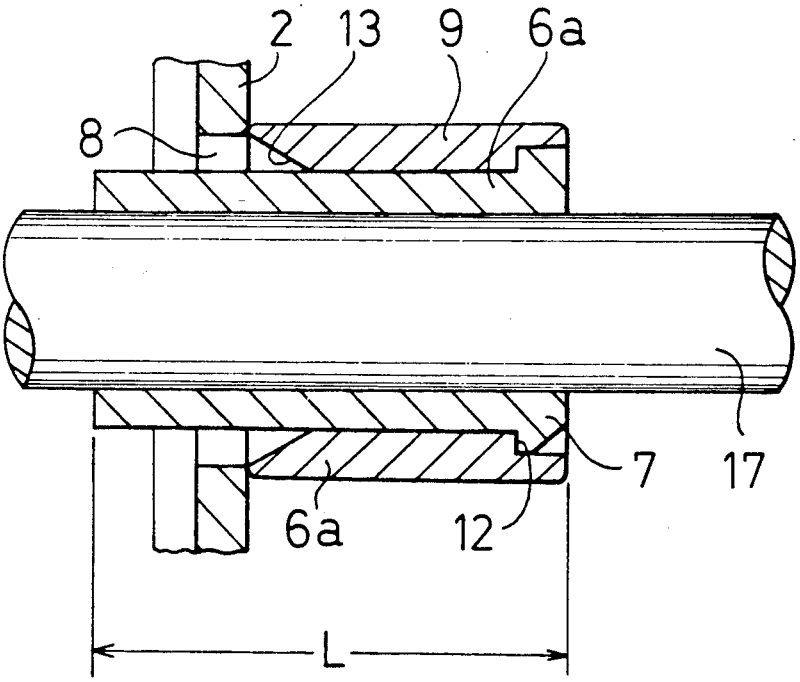
Figure 10:
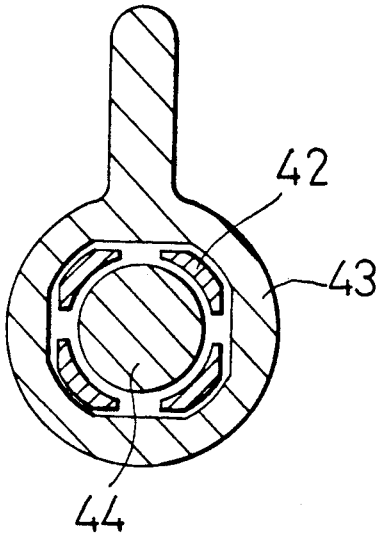
FIG. 10 PRIOR ART
Figure 11:
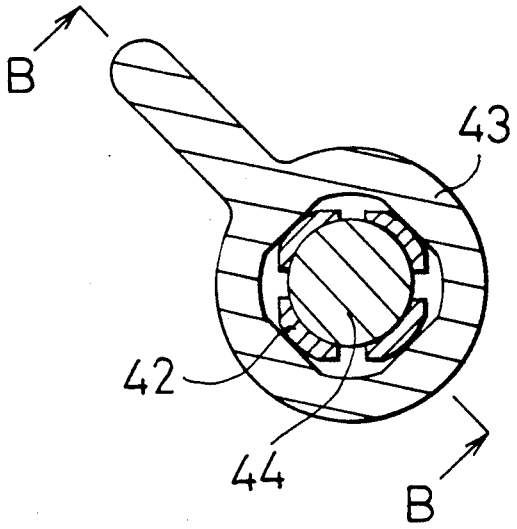
FIG. 11 PRIOR ART
Figure 12:
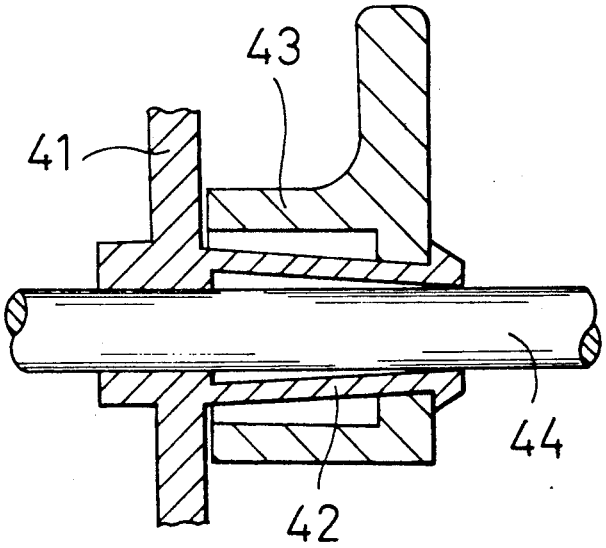
FIG. 12 PRIOR ART
Figure 13:
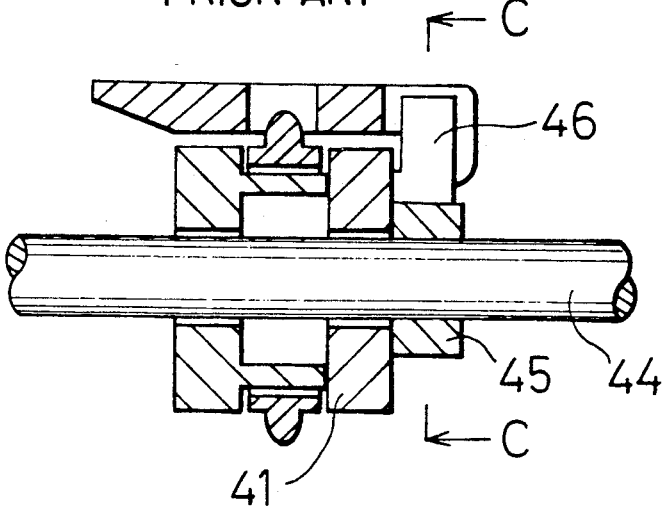
FIG. 13 PRIOR ART
Figure 14:
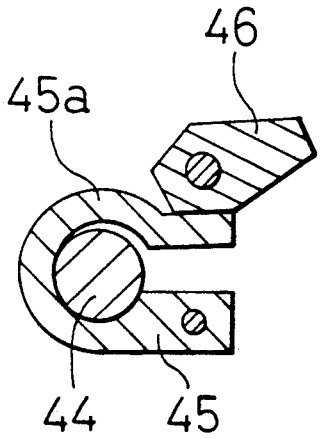
FIG. 14 PRIOR ART
Figure 15:
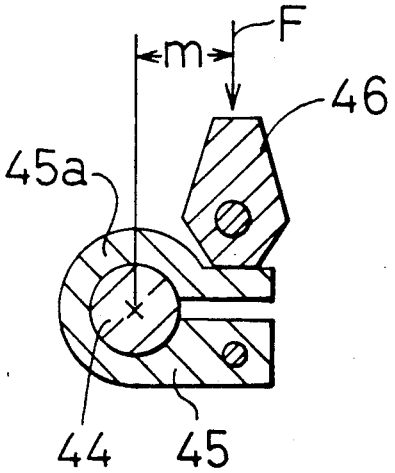
FIG. 15 PRIOR ART
Figure 16:
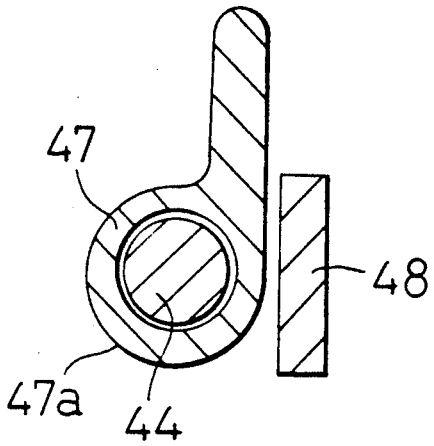
FIG. 16 PRIOR ART
Figure 17:
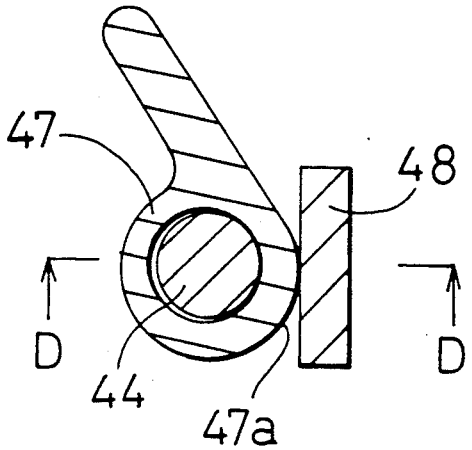
FIG. 17 PRIOR ART
Figure 18:
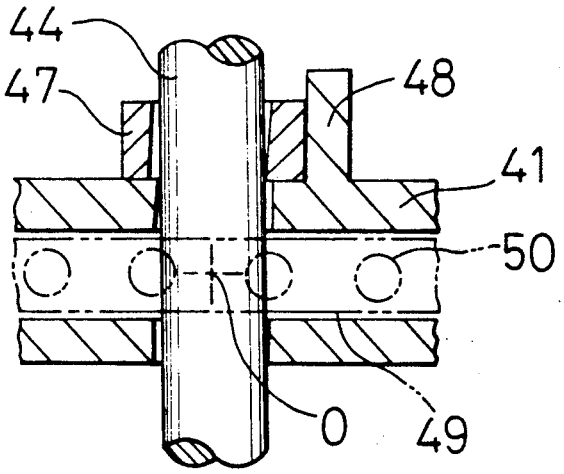
FIG. 18 PRIOR ART

As shown in FIGS. 2, 4 and 8, arcuate holes 8 are formed in the frame 2 outside each holder plate 6*a* to allow the base end of each holder plate 6*a* to extend through the frame 2.

A cylindrical clamp member 9 is fitted rotatably to the outside of the holder member 6 consisting of the pair of holder plates 6*a*. A rotation lever 11 is fitted to this clamp member 9. An engagement surface 12 for engaging with the protuberance 7 of the holder plate 6*a* is formed on one of the internal end surfaces of the clamp member 9 and a pair of taper portions 13, which are used for fitting the clamp member 9 onto the outside of the holder member 6, are disposed on the other internal end surface.

The clamp member 9, too, is made of a resin and when a large external force acts on it, the clamp member 9 can undergo slight elastic deformation in its radial direction.

As shown in FIGS. 2 and 4, a first application outer peripheral surface 14 having a radius $R_1$ and a second application outer peripheral surface 15 having a radius $R_2$ are formed continuously in the circumferential direction through a gentle step 16 on the outer peripheral surface of each holder plate 6*a*. The radius $R_2$ of the second application outer peripheral surface 15 is greater than the radius $R_1$ of the first application outer peripheral surface 14, and the second application outer peripheral surface 15 having a greater radius is formed at the free end portion of each holder plate 6*a* in the circumferential direction. The first and second application outer peripheral surfaces 14, 15 are formed on each holder plate 6*a* *180°* from each other in the circumferential direction. A clamp inner peripheral surface 18 having a radius $r_3$ a little bit greater than the radius $R_o$ of the support shaft 17 is formed on the inner peripheral surface of each holder plate 6*a*. The centers $O_1$ of the first and second application outer peripheral surfaces 14, 15 and the clamp inner peripheral surface 18 are common to one another (i.e. the surfaces 14, 15 are coaxial). As seen best in FIG. 2, each of the holder plates 6*a* has a cross section which is constant along substantially an entire length thereof.

Figure 5:
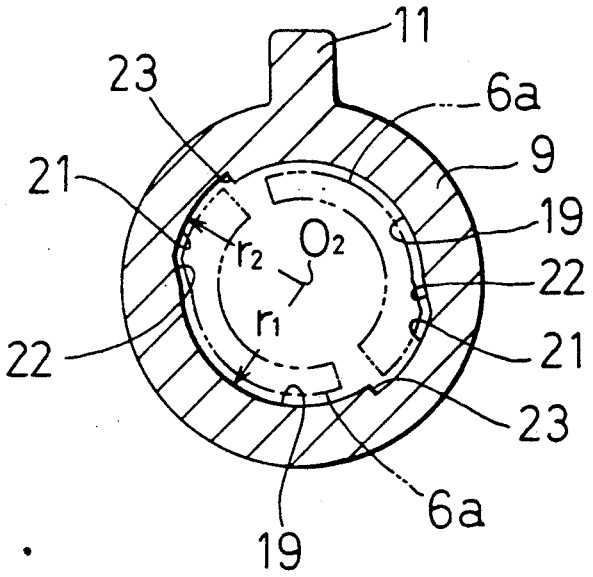

As shown in FIG. 5, a first application inner peripheral surface 19 having a radius $r_1$ and a second application inner peripheral surface 21 having a radius $r_2$ are formed continuously in the circumferential direction through a gentle step 22 at respective portions obtained by bisecting the inner peripheral surface of the cylindrical clamp member 9 in the circumferential direction. One of the ends of the second application inner peripheral surface 21 is connected to the first application inner peripheral surface 19 by a gentle step 22 and the other end is connected to the other first application inner peripheral surface 19 through a steep step 23.

The centers $O_2$ of the first and second application inner peripheral surfaces 19 and 21 are common to each other.

The radius $R_1$ of the first application outer peripheral surface 14 and the radius $R_2$ of the second application outer peripheral surface 15 formed on each holder plate 6*a* and the radius $r_1$ of the first application inner peripheral surface 19 and the radius $r_2$ of the second application inner peripheral surface 21 formed on the clamp member 9 have the following relationship:

$$r_1 > R_1;$$
$$r_2 > R_2; \text{ and}$$
$$R_2 > r_1, (R_2 - r_1 = \delta_1).$$

The radius $r_3$ of the clamp inner peripheral surface 18 formed on the holder plate 6*a* and the radius $R_o$ of the support shaft 17 have the following relationship:

$$r_3 > R_o, (r_3 - R_o = \delta_2).$$

Furthermore, $\delta_1$ $(=R_2-r_1)$ and $\delta_2$ $(=r_3-R_o)$ have the following relationship:

$$\delta_1(=R_2-r_1) > \delta_2(=r_3-R_o).$$

Therefore, as shown in FIG. 8, when the pair of taper portions 13 formed on one of the end surfaces of the clamp member 9 are engaged about the taper portions 7a of the fall-off prevention protuberances 7 projecting from each holder plate 6a and the clamp member 9 is pushed under such a state, each holder plate 6a undergoes elastic deformation and deflection in the axial direction (longitudinal direction). When the clamp member 9 is further pushed, the fall-off prevention protuberances 7 disposed on each holder plate 6a and the engagement surfaces 12 formed on the other end surface of the clamp member 9 engage with one another and the clamp member 9 is fitted rotatably about the pair of holder plates 6a.

Figure 6:
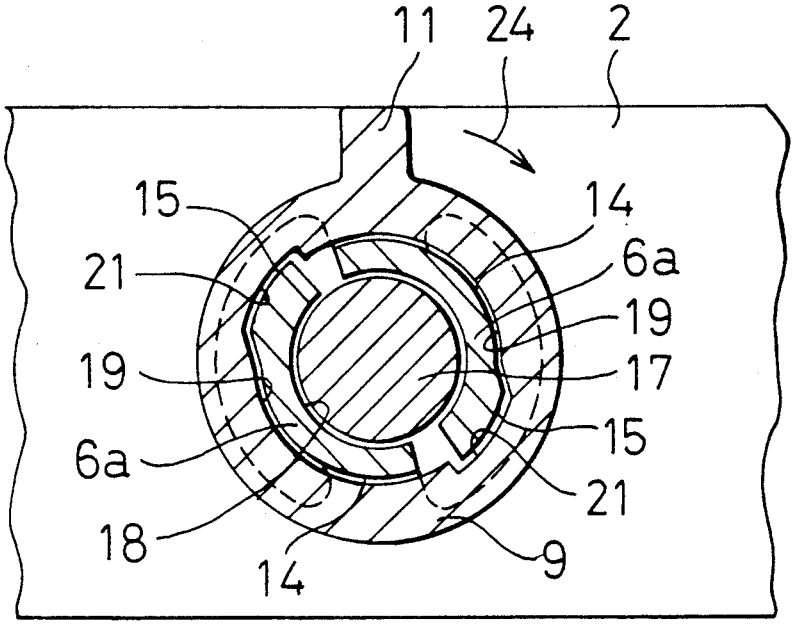
Figure 7:
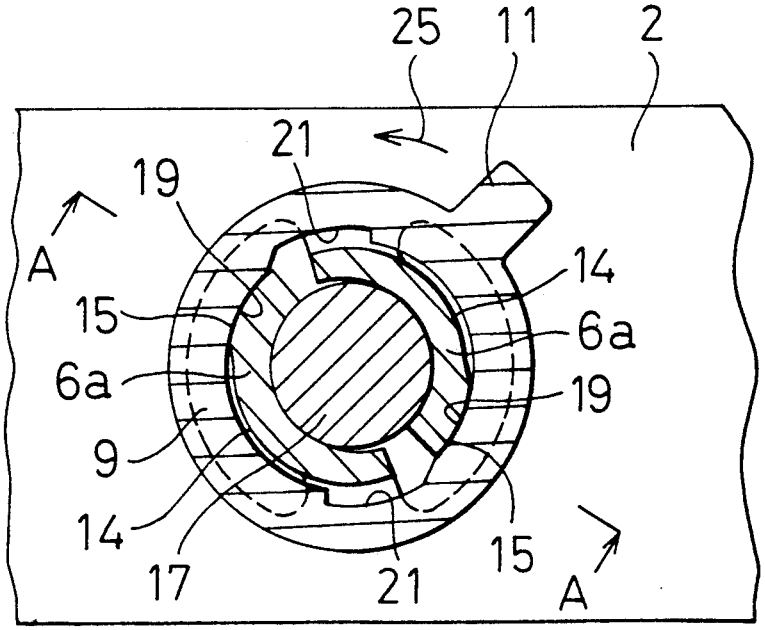

FIGS. 6 and 7 are transverse sectional views of the portion of the clamp member 9 in the unclamped state and in the clamped state, respectively.

In the unclamped state, predetermined gaps are defined between the first application outer peripheral surface 14 of the holder plate 6a and the first application inner peripheral surface 19 of the clamp member 9 and between the second application outer peripheral surface 15 of the holder plate 6a and the second application inner peripheral surface 21 of the clamp member 9, and a predetermined gap is also defined between the clamp inner peripheral surface 18 of each holder plate 6a and the outer peripheral surface of the support shaft 17.

In the clamped state, when the clamp member 9 is rotated by a predetermined angle by the lever 11 in a direction indicated by an arrow 24, the first application inner peripheral surface 19 formed on the inner peripheral surface of the clamp member 9 runs onto the second application outer peripheral surface 15 formed on the outer peripheral surface of each holder plate 6a.

Here, the radius $r_1$ of the first application inner peripheral surface 19 formed on the clamp member 9 and the radius $R_2$ of the second application outer peripheral surface 15 formed on the holder plate 6a have the relationship $[R_2 > r_1)(R_2 - r_1 = \delta_1)]$ as described already.

Therefore, when the application inner peripheral surface 19 of the clamp member 9 runs onto the second application outer peripheral surface 15 formed on the holder plate 6a, the free end portion of each holder plate 6a in the circumferential direction (the portion where the second application outer peripheral surface 15 is formed) undergoes elastic deformation and each holder plate 6a undergoes deflection in the circumferential direction.

As described above, the difference ($\delta_1$) between the radius $R_2$ of the application outer peripheral surface 15 of the holder plate 6a and the radius $r_1$ of the first application inner peripheral surface 19 of the clamp member 9 is greater than the difference ($\delta_1$) between the radius $r_3$ of the clamp inner peripheral surface 18 of the holder plate 6a and the radius $R_o$ of the support shaft 17. Therefore, when the first application inner peripheral surface 19 formed on the clamp member 9 runs onto the second application outer peripheral surface 15 formed on the holder plate 6a and each holder plate 6a undergoes deflection in the circumferential direction, the free end portion of each holder plate 6a in the circumferential direction undergoes deformation of $(\delta_1 - \delta_2)$ in the radial direction and a clamp force is thus generated. This clamp force is substantially proportional to $(\delta_1 - \delta_2)$ and becomes greater when the latter is increased.

Accordingly, since each holder plate 6a constituting the holder member 6 comes into close contact with the support shaft 17 along a predetermined length (the length represented by L in FIG. 9) in the axial direction throughout its entire surface, the clamp force becomes great and at the same time, rectangularity of the paper feed tractor clamped to the support shaft 17 becomes high relative to the support shaft 17. That is, the paper feed tractor remains proper aligned in a direction substantially perpendicular to the support shaft 17.

Since the paper feed tractor 1 can be fixed while keeping high rectangularity to the support shaft 7 as described above, paper feed accuracy of paper feed tractor 1 can be improved. Since the present invention employs the structure wherein a great clamping force is obtained as the pair of holder plates 6a come into close contact with the support shaft 17 along a predetermined length in the axial direction, the intended clamp force can be obtained even when the length of the pair of holder plates 6a projecting from the side surface of the frame 2 is reduced.

Since the positions of the first and second application outer peripheral surfaces 14, 15 formed on each of the pair of holder plates 6a deviate by 180° from each other in the circumferential direction (i.e., are at diametrically opposing positions), the holder plates 6a come into close contact with the support shaft 17 at the diametrically opposite positions in the circumferential direction. Accordingly, even when the holder plates 6a undergo deflection in the circumferential direction at the time of clamping, the axes of the holder plates 6a do not deviate from the axis of the support shaft 17 (i.e. the holder plates remain coaxial with support shaft 17) and the paper feed tractor 1 can be clamped to the support shaft 17 without such a deviation.

The unclamped state is established when the clamp member 9 is rotated by a predetermined angle in the direction of the arrow 25 from the clamped state shown in FIG. 7.

What is claimed is:

1. A paper feed tractor clamp for clamping a paper feed tractor to a support shaft, comprising:

a substantially cylindrical elongated holder member having a central axis and being adapted to extend as a cantilever from a frame of the paper tractor in coaxial surrounding relation with the support shaft, said holder member comprising a pair of substantially semi-cylindrical holder plates elongated in the axial direction of said holder member, each of said holder plates having a substantially semi-cylindrical inner peripheral surface, a first outer peripheral surface having a first radius of curvature, a second outer peripheral surface having a second radius of curvature larger than said first radius of curvature, and a sloped outer peripheral portion joining said first and second outer peripheral surfaces, said holder plates being arranged about said axis such that said second outer peripheral surface of each of said holder plates is diametrically opposite said second outer peripheral surface of the other of said holder plates; and a substantially cylindrical clamp member rotatably mounted about said holder member and having a pair of first inner peripheral surfaces having a third radius of curvature, a pair of second inner peripheral surfaces having a fourth radius of curvature larger than said third radius of curvature, and a pair of sloped inner peripheral portions respectively joining one of said second inner peripheral surfaces with one of said first inner peripheral surfaces and the other of said second inner peripheral surfaces with the other of said first inner peripheral surfaces, such that an outer periphery of said holder member is complementarily shaped with respect to an inner periphery of said clamp member and when said clamp member is rotated relative to said holder member away from a position in which said second outer peripheral surfaces of said holder member are adjacent said second inner peripheral surfaces of said clamp member, said holder member is forced into a clamping condition in which it deflects radially inwardly such that it is adapted to clamp against the support shaft;

wherein each of said holder plates has a cross section which is constant along substantially an entire length thereof, such that when said holder member is forced into said clamping condition, said holder plates are adapted to clampingly contact the support shaft along a length thereof substantially equal to the entire length of each of said holder plates, wherein each of said holder plates extends along substantially an entire axial length of said holder member;

wherein said holder plates are separated from one another along their entire lengths at two circumferential locations of said holder member; and wherein said sloped outer peripheral portions of said holder plates, respectively, and said sloped inner peripheral portions of said substantially cylindrical clamp member are formed such that, together, they define a means for reducing frictional resistance to rotation of said clamp member relative to said holder member when said holder member is being forced into said clamping condition.

2. A paper feed tractor clamp as recited in claim 1, further comprising means for preventing said clamp member from falling off said holder member.

3. A paper feed tractor clamp as recited in claim 2, wherein said preventing means comprises at least one radially outwardly projecting protuberance formed at a free end of said holder member.

4. A paper feed tractor clamp as recited in claim 3, wherein said at least one protuberance has a radially outwardly facing taper portion, and said clamp member has a radially inwardly facing taper portion at an end thereof upon which said at least one outwardly facing taper portion is adapted to ride.

5. A paper feed tractor clamp as recited in claim 2, wherein said preventing means comprises a radially outwardly projecting protuberance formed at a free end of each of said holder plates.

6. A paper feed tractor clamp as recited in claim 5, wherein each of said protuberances has a radially outwardly facing taper portion, and said clamp member has a radially inwardly facing taper portion at an end thereof upon which said radially outwardly facing taper portion of each of said protuberances is adapted to ride.

7. A paper feed tractor comprising:

a tractor frame; and a tractor clamp comprising a substantially cylindrical elongated holder member having a central axis and extending as a cantilever from said frame and adapted to be in coaxial surrounding relation with a tractor support shaft, said holder member comprising a pair of substantially semi-cylindrical holder plates elongated in the axial direction of said holder member, each of said holder plates having a substantially semi-cylindrical inner peripheral surface, a first outer peripheral surface having a first radius of curvature, a second outer peripheral surface having a second radius of curvature larger than said first radius of curvature, and a sloped outer peripheral portion joining said first and second outer peripheral surfaces, said holder plates being arranged about said axis such that said second outer peripheral surface of each of said holder plates is diametrically opposite said second outer peripheral surface of the other of said holder plates, and a substantially cylindrical clamp member rotatably mounted about said holder member and having a pair of first inner peripheral surfaces having a third radius of curvature, a pair of second inner peripheral surfaces having a fourth radius of curvature larger than said third radius of curvature, and a pair of sloped inner peripheral portions respectively joining one of said second inner peripheral surfaces with one of said first inner peripheral surfaces and the other of said second inner peripheral surfaces with the other of said first inner peripheral surfaces, such that an outer periphery of said holder member is complementarily shaped with respect to an inner periphery of said clamp member and when said clamp member is rotated relative to said holder member away from a position in which said second outer peripheral surfaces of said holder member are adjacent said second inner peripheral surfaces of said clamp member, said holder member is forced into a clamping position in which it deflects radially inwardly such that it is adapted to clamp against the support shaft, wherein each of said holder plates has a cross section which is constant along substantially an entire length thereof, such that when said holder member is forced into said clamping condition, said holder plates are adapted to clampingly contact the support shaft along a length thereof substantially equal to the entire length of each of said holder plates, wherein each of said holder plates extends along substantially an entire axial length of said holder member, wherein said holder plates are separated from one another along their entire lengths at two circumferential locations of said holder member, and wherein said sloped outer peripheral portions of said holder plates, respectively, and said sloped inner peripheral portions of said substantially cylindrical clamp member are formed such that, together, they define a means for reducing frictional resistance to rotation of said clamp member relative to said holder member when said holder member is being forced into said clamping condition.

8. A paper feed tractor clamp as recited in claim 7, further comprising;

means for preventing said clamp member from falling off said holder member.

9. A paper feed tractor clamp as recited in claim 8, wherein said preventing means comprises at least one radially outwardly projecting protuberance formed at a free end of said holder member.

10. A paper feed tractor clamp as recited in claim 9, wherein said at least one protuberance has a radially outwardly facing taper portion, and said clamp member has a radially inwardly facing taper portion at an end thereof upon which said at least one outwardly facing taper portion is adapted to ride.

11. A paper feed tractor clamp as recited in claim 8, wherein said preventing means comprises a radially outwardly projecting protuberance formed at a free end of each of said holder plates.

12. A paper feed tractor clamp as recited in claim 11, wherein each of said protuberances has a radially outwardly facing taper portion, and said clamp member has a radially inwardly facing taper portion at an end thereof upon which said radially outwardly facing taper portion of each of said protuberances is adapted to ride.

13. A paper feed tractor clamp as recited in claim 7, wherein said tractor frame includes a frame member having a pair of arcuate holes formed therein; and each of said substantially semi-cylindrical holder plates extends through a respective one of said pair of arcuate holes.

* * * * *